US006920737B2

(12) United States Patent
Haws et al.

(10) Patent No.: US 6,920,737 B2
(45) Date of Patent: Jul. 26, 2005

(54) METHOD AND APPARATUS FOR CONTROLLING ZIPPER REGISTRATION IN PACKAGING EQUIPMENT

(75) Inventors: Lewis Albert Haws, Duluth, GA (US); David C. Wallace, Lilburn, GA (US)

(73) Assignee: Illinois Tool Works Inc., Glenview, IL (US)

( * ) Notice: Subject to any disclaimer, the term of this patent is extended or adjusted under 35 U.S.C. 154(b) by 2 days.

(21) Appl. No.: 10/645,091

(22) Filed: Aug. 21, 2003

(65) Prior Publication Data

US 2005/0039418 A1 Feb. 24, 2005

(51) Int. Cl.[7] ..... B65B 47/00; B65B 61/18

(52) U.S. Cl. ..... 53/412; 53/453; 53/133.4; 53/559

(58) Field of Search ..... 53/133.4, 139.2, 53/412, 453, 559; 156/66; 493/213, 214

(56) References Cited

U.S. PATENT DOCUMENTS 4,437,293 A * 3/1984 Sanborn, Jr. ..... 53/412
4,826,065 A 5/1989 Natterer et al. ..... 226/173
4,969,309 A * 11/1990 Schwarz et al. ..... 53/412
5,105,603 A 4/1992 Natterer ..... 53/412
6,526,726 B1 * 3/2003 Strand et al. ..... 53/412
6,701,695 B1 * 3/2004 Douglas ..... 53/133.4
6,804,935 B2 * 10/2004 Schneider et al. ..... 53/133.4

* cited by examiner

*Primary Examiner*—John Sipos
(74) *Attorney, Agent, or Firm*—Ostrager Chong Flaherty & Broitman P.C.

(57) ABSTRACT

Methods and apparatus for controlling the registration of one elongated continuous structure (e.g., plastic zipper) with attachments or formed features (e.g., sliders or pre-seals) as it is fed to a sealing station, where it is joined to another elongated continuous structure (e.g., packaging film) with formed features (e.g., thermoformed pockets). The latter elongated continuous structure will be intermittently advanced through the machine, pulling the former elongated continuous structure joined thereto forward. Registration is accomplished by tacking the respective elongated continuous structures together while the respective features on the elongated continuous structures are in proper registration. After tacking, the respective portions of the elongated continuous structures immediately downstream of the tack zone are advanced to the sealing station in proper registration.

16 Claims, 7 Drawing Sheets

METHOD AND APPARATUS FOR CONTROLLING ZIPPER REGISTRATION IN PACKAGING EQUIPMENT

BACKGROUND OF THE INVENTION

The present invention generally relates to methods and apparatus for controlling the registration of one web, tape or strand of continuous plastic material relative to another web, tape or strand of elongated continuous structure, both of which are being fed to a packaging machine. In particular, the invention relates to methods and apparatus for controlling the registration of a continuous zipper material relative to a continuous web in a thermoforming packaging machine.

In cases where a continuous zipper without pre-sealing and without sliders must be joined with a continuous web of packaging film having thermoformed pockets, there is a need for the zipper to be properly aligned with the web of film (i.e., straightness and cross-machine alignment), but there is no need to register the zipper relative to the web in a machine direction. This is due to the fact that the zipper has a constant profile along its length and thus has no structural features that need to be registered relative to the pockets thermoformed on the web of packaging film.

The continuous zipper material typically comprises a pair of continuous zipper strips, each zipper strip having a respective constant profile produced by extrusion. Typically, the respective zipper strip profiles have complementary shapes that allow the zipper strips to be interlocked. These closure profiles may be of the rib-and-groove variety, the interlocking-hook variety or any other suitable fastenable structures. Pre-sealing of the zipper material involves crushing and fusing the zipper strips at spaced intervals along the zipper at locations where the zipper material will be ultimately cut when each finished package is severed from work in process. In cases where the zipper material is pre-sealed before entering the packaging machine, it is important that the pre-seals be properly registered relative to the pockets thermoformed on the web of packaging film.

In cases where sliders are inserted at spaced intervals along the zipper before the latter enters the packaging machine, it is common to combine the joinder of the zipper strips at spaced intervals with the formation of slider end stop structures on the zipper. Although slider end stops can be placed on or inserted in the zipper, it is common practice to simply deform and fuse the thermoplastic material of the zipper strips wherever slider end stops are needed. Typically, the zipper material is deformed by application of ultrasonic wave energy and shaping the thus-softened zipper material to form a slider end stop structure. Typically the slider end stop structure forms back-to-back slider end stops when bisected. The slider end stop structure is formed at a location such that its midplane will be coplanar with the plane of cutting when the finished package is severed from the work in process. Thus, it is important that the slider end stop formations on the zipper be properly registered relative to the pockets thermoformed on the web of packaging film.

There is a need for a simple, inexpensive and accurate scheme for controlling the registration of one elongated continuous structure (e.g., plastic zipper), with attachments (e.g., sliders) or formed features (e.g., slider end stop structures), as it is fed to a sealing station, where it is joined to and later pulled by another elongated continuous structure (e.g., a web of packaging film), with formed features (e.g., thermoformed pockets or troughs). The registration control equipment should also be easy to install. Also, the scheme for controlling registration of the pulled elongated continuous structure relative to the pulling elongated continuous structure should be adaptable to machines in which each advance of the latter is equal in distance to a single unit or package length or multiple unit or package lengths.

BRIEF DESCRIPTION OF THE INVENTION

The present invention is directed to methods and apparatus for controlling the registration of one elongated continuous structure (e.g., plastic zipper), with attachments (e.g., sliders) or formed features (e.g., slider end stop structures), as it is fed to a sealing station, where it is joined to and later pulled by another elongated continuous structure (e.g., a web of packaging film), with formed features (e.g., thermoformed pockets or troughs). The pulling elongated continuous structure will be intermittently advanced through the machine, pulling the pulled elongated continuous structure joined thereto forward. Registration is accomplished by tacking the respective elongated continuous structures together at a tacking station located upstream of the sealing station. Proper registration is ensured by controlling the tension of the pulled elongated continuous structure during tacking.

In the case where the pulled elongated continuous structure is zipper material and the pulling elongated continuous structure is a web of packaging film, tacking eliminates cross-machine wandering of the zipper going into the zipper sealing station. Tacking also facilitates threading of the zipper through the zipper sealing station during startup.

The registration control scheme disclosed herein can be applied in cases wherein the joined elongated continuous structures advance a single unit or package length per advancement as well as cases wherein the joined elongated continuous structures advance a distance equal to multiple unit or package lengths per advancement.

Although the embodiments disclosed hereinafter involve the manufacture of thermoformed packages with slider-zipper assemblies, it should be appreciated that the broad concept of the invention has application in other situations wherein two elongated continuous structures must be alternatingly joined and advanced while maintaining accurate registration of the materials upstream of the zone of joinder.

One aspect of the invention is a method of manufacture comprising the following steps: (a) intermittently advancing a first elongated continuous structure made of flexible material along a process pathway during each work cycle, each advance of the first elongated continuous structure being equal in distance to one unit length, the first elongated continuous structure not advancing during a dwell time of each work cycle; (b) during each dwell time, forming a respective structural feature on the first elongated continuous structure, the structural features being spaced at regular intervals, one structural feature per unit length; (c) during each dwell time, tacking a respective zone on a second elongated continuous structure made of flexible material to a respective zone on the first elongated continuous structure, the tack zones being spaced at regular intervals along a line that does not intersect the structural features on the first elongated continuous structure, one tack zone per unit length, and being generally aligned with respective zones separating those structural features; (d) during each dwell time, joining the first and second elongated continuous structures along a respective line segment connecting successive tack zones. An untacked and unjoined trailing section of the second elongated continuous structure is pulled forward when the first elongated continuous structure is advanced.

Another aspect of the invention is a method of manufacture comprising the following steps: (a) intermittently advancing a first elongated continuous structure made of flexible material along a process pathway during each work cycle, each advance of the first elongated continuous structure being equal in distance to N unit lengths, where N is a positive integer greater than unity; the first elongated continuous structure not advancing during a dwell time of each work cycle; (b) during each dwell time, forming a respective set of N structural features on the first elongated continuous structure, the structural features of each set being spaced at regular intervals in a respective section having a length equal to N unit lengths, one structural feature per unit length; (c) during each dwell time, tacking a respective zone on a second elongated continuous structure made of flexible material to a respective zone on the first elongated continuous structure, the tack zones being spaced at regular intervals along a line that does not intersect the structural features on the first elongated continuous structure, one tack zone per N unit lengths, and being generally aligned with respective zones separating successive structural features; (d) during each dwell time, joining the first and second elongated continuous structures along at least portions of a respective line segment connecting successive tack zones, so that the first and second elongated continuous structures are joined along at least a major portion of each of the line segments connecting successive tack zones. An untacked and unjoined trailing section of the second elongated continuous structure is pulled forward when the first elongated continuous structure is advanced.

A further aspect of the invention is a packaging machine comprising: means for advancing a packaging material in a machine direction; means for thermoforming a pocket on a packaging material; means for joining a band-shaped portion of a zipper material to the packaging material; and means for tacking a spot-shaped portion of the zipper material to the packaging material, the tacking means being upstream of the joining means and downstream of the thermoforming means, and the tacking means and the joining means being generally aligned with each other and laterally offset in a cross direction relative to the thermoforming means.

Yet another aspect of the invention is a packaging machine comprising: means for advancing a packaging material in a machine direction; means for concurrently thermoforming N pockets on a packaging material, where N is a positive integer greater than unity, the pockets being spaced at regular intervals, one pocket per package length; means for joining a band-shaped portion of a zipper material to the packaging material, the band-shaped zone of joinder having a length equal to almost or about N package lengths; and means for tacking a spot-shaped portion of the zipper material to the packaging material, the tacking means being upstream of the joining means and downstream of the thermoforming means, and the tacking means and the joining means being generally aligned with each other and laterally offset in a cross direction relative to the thermoforming means.

A further aspect of the invention is a machine comprising: N thermoforming die(s) for forming, by application of heat and vacuum, a respective pocket in each of a succession of package-length sections of a web of film, where N is a positive integer; means for intermittently advancing the web by a distance equal to N package length(s) per advance; a tacking station located downstream of the thermoforming die(s), the tacking station comprising a first sealing mechanism for joining, by application of energy, respective portions of a zipper strip to respective portions of the web in a series of spot-shaped tacking zones spaced at regular intervals along the length of the zipper strip, one tacking zone per stroke of the advancing means, the tacked zipper strip being offset from the pockets and not overlapping therewith; and a sealing station located downstream of the tacking station, the sealing station comprising a second sealing mechanism for joining, by application of energy, respective portions of a zipper strip to respective portions of the web in a series of band-shaped sealing zones connecting the tacking zones.

Yet another aspect of the invention is a system comprising a packaging machine, a zipper processing machine, and a continuous zipper material that follows a process pathway through the zipper processing machine and then through the packaging machine, wherein: the continuous zipper material comprises a first continuous zipper strip interlocked with a second continuous zipper strip; the packaging machine comprises a tacking station whereat a respective first portion of the first zipper strip is joined to a respective first portion of a continuous packaging material during a first portion of each work cycle, a sealing station whereat a respective second portion of the first zipper strip is joined to a respective second portion of a continuous packaging material during the first portion of each work cycle, and means for advancing the continuous packaging material during a second portion of each work cycle, the first and second portions being in alternating sequence, each of the second portions of a length in a machine direction substantially greater than a length in the machine direction of each of the first portions; and the zipper processing machine comprises a slider insertion device and tension control means for maintaining a substantially constant tension of the zipper material in a zone from the slider insertion device to the tacking station during the first portion of each work cycle.

A further aspect of the invention is a packaging machine comprising: means for gripping respective edges of a continuous web of packaging film, the edges being parallel with a machine direction; a thermoforming die designed to form a pocket in a confronting portion of a gripped web by application of heat and vacuum, the pocket having a pocket length; a retractable tacking device offset in a cross direction relative to the thermoforming die, the tacking device comprising a contact surface that emits energy when the tacking device is activated, the contact surface of the tacking device having a dimension in the machine direction that is substantially less than the pocket length; and a retractable sealing device offset in a cross direction relative to the thermoforming die, the sealing device comprising a contact surface that emits energy when the sealing device is activated, the contact surface of the sealing device having a dimension in the machine direction that is greater than the pocket length. The contact surfaces of the tacking and sealing devices lie along a line that is parallel with the machine direction and are separated by a space when the tacking and sealing devices are extended, the contact surface of the sealing device being located downstream relative to the contact surface of the tacking device, and the line being offset in a cross direction and located downstream in a machine direction relative to the thermoforming die.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

A number of embodiments of the present invention will be described in the context of a thermoforming packaging machine that applies zipper material with sliders to packaging material. However, it should be understood that the invention is not limited in its application to thermoformed packaging machines. The broad scope of the invention will be apparent from the claims that follow this detailed description.

Figure 1:
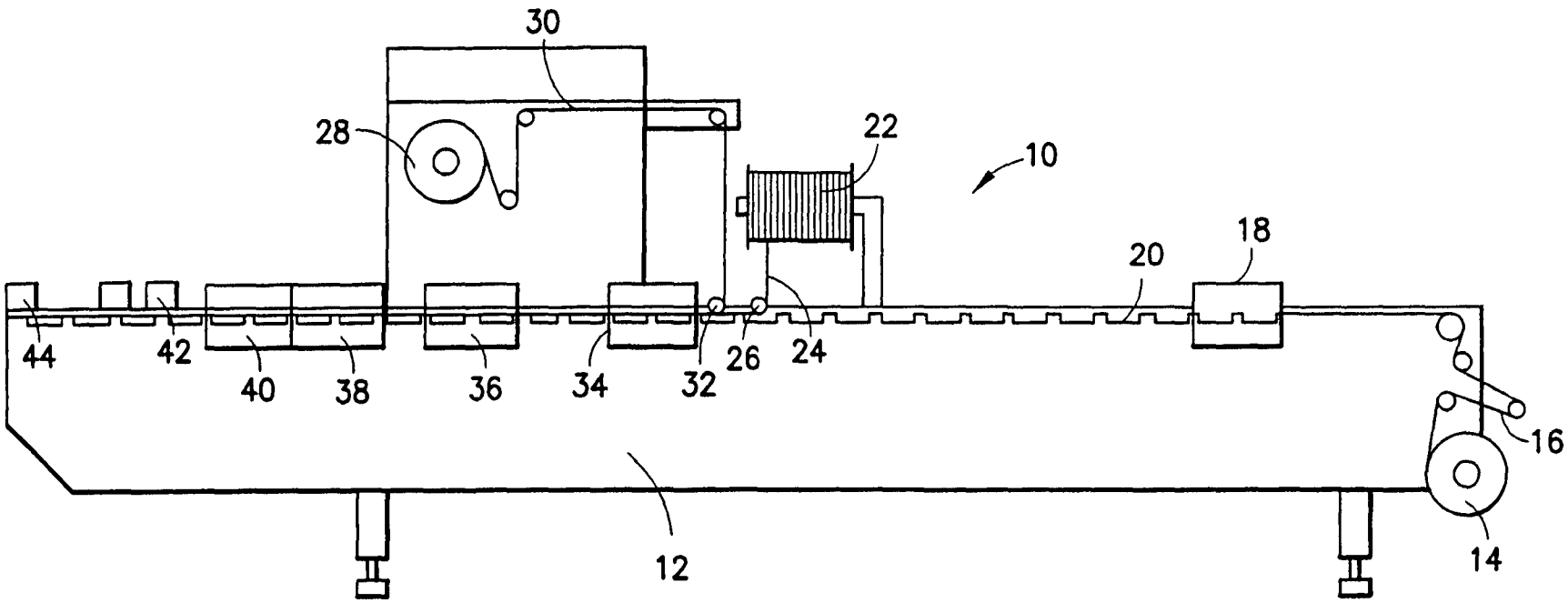
FIG. 1 PRIOR ART
FIG. 1 is a drawing showing a side view of a known thermoforming packaging machine with omitted front plate.

Referring to FIG. 1, a known thermoforming packaging machine 10 comprises a machine frame 12 with an inlet side and an outlet side. A bottom web of packaging film 16 is unrolled from a supply roll 14 located at the inlet side, grasped by clamper chains (not shown) guided at both sides of the machine frame in known manner and passed to the outlet side through the various working stations. The bottom film 16 is first fed to a forming station 18, where trough-shaped containers or pockets 20 for receiving the product (not shown) to be packed are formed by deep-drawing using vacuum and heat. At a position following the filling station (not shown in FIG. 1), a closure means 24 is unrolled from a supply roll 22 and fed around a deflection roller 26 onto the bottom film 16 such that the closure means 24 are deposited on the film section between the thermoformed pockets 20 (best seen in FIG. 2).

Still referring to FIG. 1, thereafter a top or cover web of packaging film 30 is guided from a supply roll 28 via a deflection roller 32 on top of the bottom film 16 and the closure means 24. The top and bottom films, with the closure means sandwiched therebetween, are advanced to a sealing station 34 and halted. The respective sections within the sealing station are then sealed together while the films and closure means are stationary. The sealed section is thereafter advanced to the following stations in sequence: an evacuation and sealing station 36, a final or post-sealing station 38, a cooling station 40, a transverse cutting station 42, and a lengthwise (i.e., longitudinal) cutting station 44.

Figure 2:
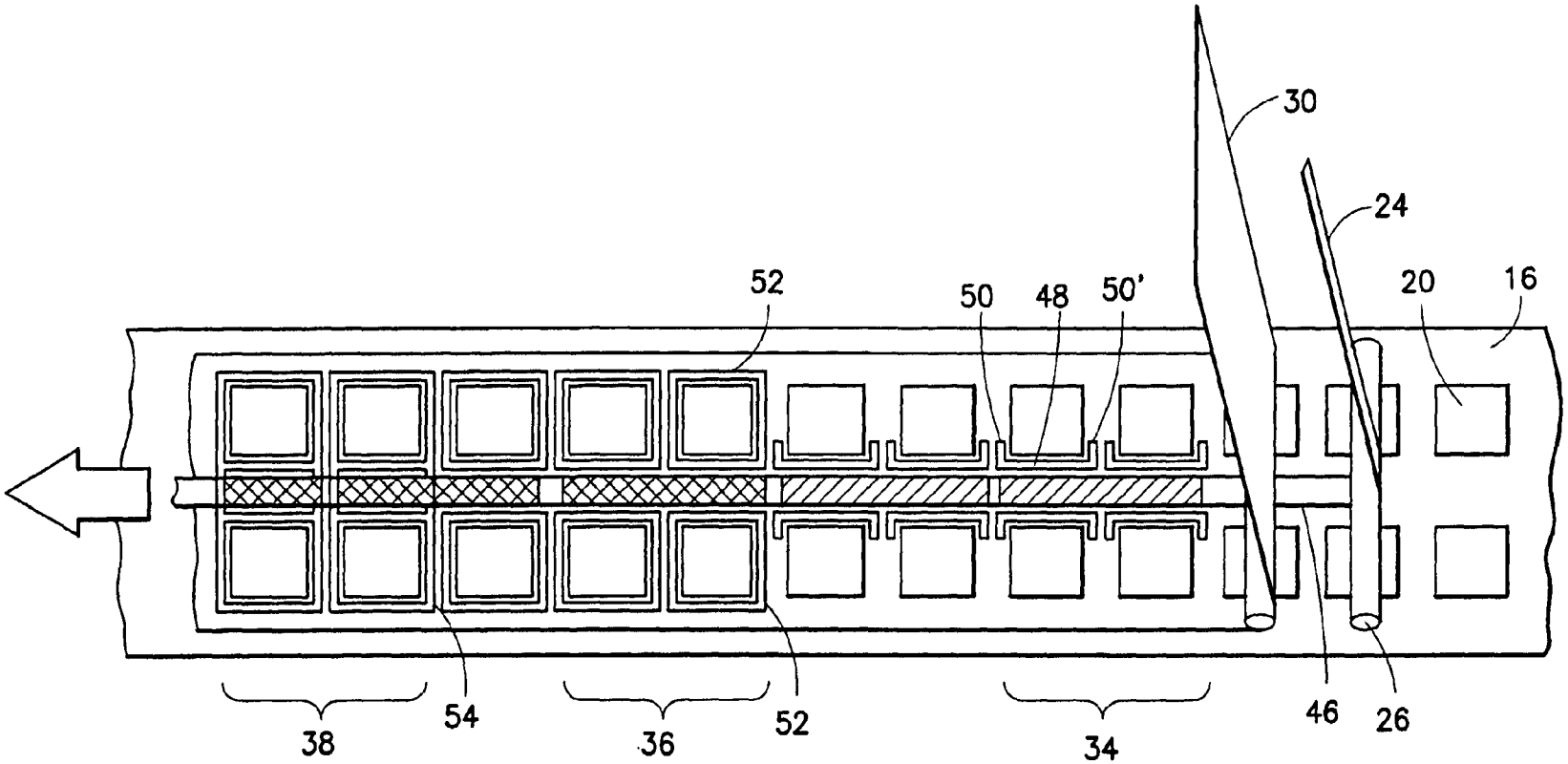
FIG.2 PRIOR ART
FIG. 2 is a drawing showing a top view of packaging film and zipper material passing through the thermoforming packaging machine depicted in FIG. 1.

As seen in the top view of the system presented in FIG. 2, all working stations are designed such that two packages are formed simultaneously and side by side in the feed or machine direction. The closure means comprises two reclosure means (e.g., respective zippers, each zipper comprising a pair of complementary zipper strips) that are provided at the outer edges of the closure strip and that can be separated from each other by a center cut. By sealing in the manner described below and subsequently cutting lengthwise between both reclosure means, two independent packages are produced which each have reclosure means. Alternatively, it is possible to design a thermoforming packaging machine that processes a chain of single packages or that processes more than two packages in each row.

FIG. 2 depicts the various sealing operations that are performed at the respective sealing stations depicted in FIG. 1. The regions 34, 36 and 38 in FIG. 2 respectively correspond to sealing stations 34, 36 and 38 in FIG. 1. The loading of each pocket 20 (not shown in FIGS. 1 and 2) occurs in the region between thermoforming station 18 and deflection roller 26.

In region 34 of FIG. 2, the hatched strips represent heat sealing of the bottom film 16 to the confronting face of a section of the closure strip 8. On each side of those heat seals, the top film 30 is sealed to the bottom film 16 along respective seal zones in the shape of square brackets. Each bracket-shaped seal zone comprises a linear seal zone 40 placed between the closure strip 8 and a respective pocket 20 and a pair of contiguous seal zones 50 and 50' extending from the ends of seal zone 40 in a transverse direction away from the closure strip, but only part way along the respective sides of the respective pocket 20. Thus, at this stage the top film is not sealed to the closure strip and is not sealed to a majority of the peripheral region surrounding each pocket 20.

In region 36 of FIG. 2, the cross-hatched strips represent heat sealing of the top film 30 to the confronting face of each section of the closure strip 8 that has already been joined to the bottom film. On each side of those heat seals, the top film 30 is sealed to the bottom film 16 along respective seal zones in the shape of square brackets, the ends of which overlap with the previously sealed zones 50 and 50', thereby completely sealing the periphery of each pocket in region 36. Each pocket in region 36 is hermetically sealed in this manner only after the inside of each filled pocket has been evacuated, which also occurs in region 36.

In region 38 of FIG. 2, a firm final sealing in the transverse direction across the total length of the packages and across the closure means is performed. The resulting transverse seal or seam is indicated with reference numeral 54 in FIG. 2. In the following stations the packages are further processed and, in particular, are severed or separated in conventional manner.

The operations of the various activatable packaging machine components depicted in FIGS. 1 and 2 may be controlled by a conventional programmed logic controller (PLC) in well-known manner.

For the sake of simplicity, the embodiments of the present invention will be described in relation to a thermoforming packaging machine in which slider-zipper assemblies are joined to only one column or chain of interconnected thermoformed packages. However, the invention can be used in conjunction with a thermoforming packaging machine having any number of rows, simply by providing respective zipper application lines for each column of packages. For example, sections of respective zipper materials having respective sliders can be concurrently attached, at a sealing station, to respective bottom film portions in a row of thermoformed containers.

In the embodiments of the invention disclosed herein, the zipper material is tacked to the packaging film, the tack zones being spaced at regular intervals, and then the zipper material is sealed to the packaging material along respective line segments connecting successive tack zones. In the embodiment shown in FIG. 3, the tack zones are spaced at regular intervals, one tack zone per package length. In the embodiment shown in FIGS. 4 and 5, the tack zones are spaced one tack zone for every two package lengths. However, the concept of the invention is extendible to packaging machines that advance the joined zipper and film more than three or more package lengths per advance.

Figure 3:
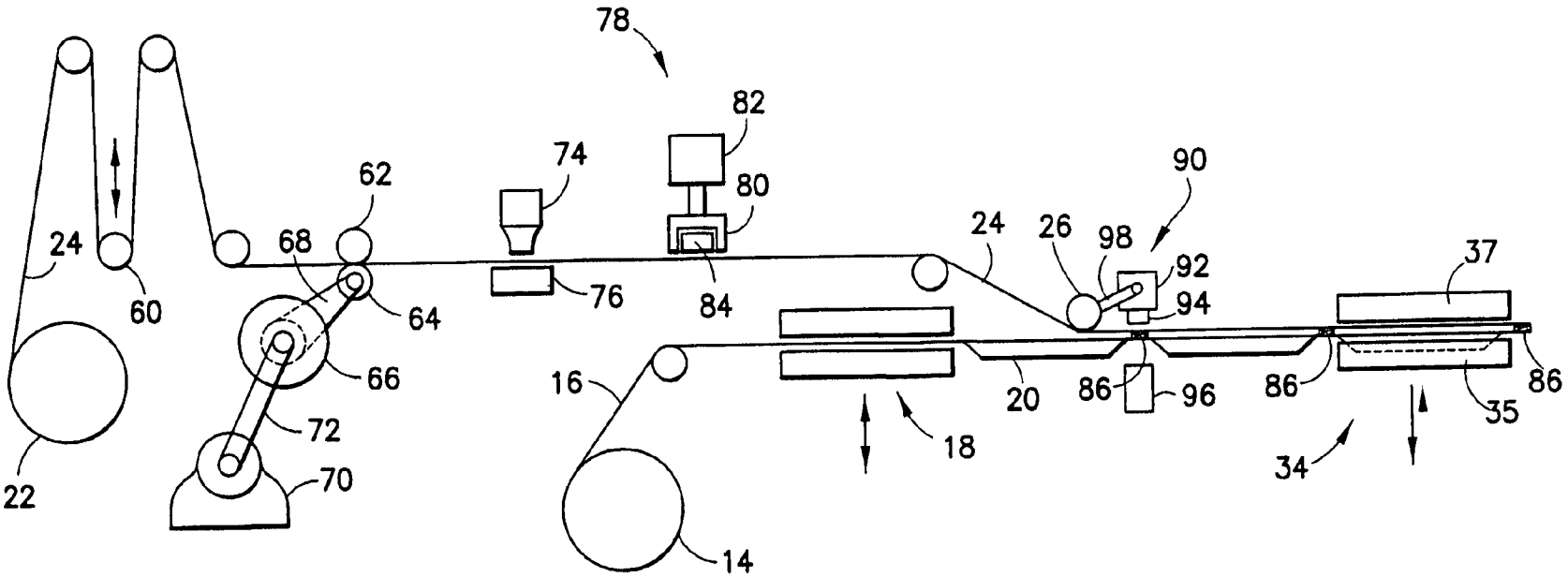
FIG. 3 is a drawing showing portions of the zipper and packaging film process pathways (which overlap inside the packaging machine) in accordance with one embodiment of the present invention. In this embodiment, the packaging machine advances the web of film one package length per advance.

A system that combines a zipper processing system with a thermoforming packaging machine is partially shown in schematic form in FIG. 3. The embodiment depicted in FIG. 3 envisions intermittent advancement of the bottom film 16, one package length per advance, in the packaging machine. The portion of the total system seen in FIG. 3 includes a zipper unwinding station (comprising a zipper supply reel 22), zipper tension control means (comprising nip rollers 62, 64 and a particle clutch 66), an ultrasonic stomping assembly (comprising a horn 74 and an anvil 76), and a slider insertion device 78 (comprising a pusher 80 and an air cylinder 82), all mounted to the frame (not shown) of the zipper processing system. The total system further comprises a film unwinding station (comprising a film supply reel 14), a thermoforming station 18, a zipper tacking station 90 and a zipper sealing station 34, all mounted to the frame of the packaging machine. The portions of the packaging machine downstream of the zipper sealing station 34 are conventional and not shown in FIG. 3. The system shown in FIG. 3 employs zipper tension control and zipper tacking to achieve accurate registration of the sliders and slider end stops on the zipper relative to the pockets in the packaging film during sealing, as explained in detail below.

In accordance with one embodiment of the invention, a strand of thermoplastic zipper material 24 is unwound from a powered supply reel 22 and passed through a dancer assembly comprising a weighted dancer roll 60 that is supported on a shaft, which shaft is freely vertically displaceable (as indicated by a double-headed arrow in FIG. 3) along a slotted support column (not shown). Downstream of the dancer, the zipper material passes through a nip formed by two rollers 62 and 64. The weight of the dancer roll takes up any slack in the portion of zipper material suspended between the supply reel 22 and the nip formed by rollers 62 and 64.

An ultrasonic shaping station is disposed downstream of the nip. During each dwell time, a respective portion of the zipper material at the shaping station is shaped to form hump-shaped slider end stop structures. Each slider end stop structure will form back-to-back slider end stops when the end stop structure is cut during package formation. The ultrasonic shaping station comprises an ultrasonic horn 74 and an anvil 76. Typically the horn 74 reciprocates between retracted and extended positions, being extended into contact with the zipper material and then activated to transmit ultrasonic wave energy for deforming the thermoplastic zipper material during each dwell time.

The shaped portion of zipper material is then advanced to the next station, comprising a conventional slider insertion device 78 that inserts a respective slider 84 onto each package-length section of zipper material during each dwell time. Each slider is inserted adjacent a respective slider end stop structure on the zipper material. The slider insertion device comprises a reciprocating pusher 80 that is alternately extended and retracted by a pneumatic cylinder 82. The other parts of such a slider insertion device, including a track along which sliders are fed, are well known and will not be described in detail herein.

In order to maintain proper registration of the sliders 84 and the slider end stops (not shown) on the zipper material 24 relative to the pockets or containers 20 thermoformed in the bottom film 16, it is critical that the tension in the zipper material be controlled in the zones where the zipper shaping, slider insertion and zipper tacking stations are located.

In the embodiment depicted in FIG. 3, the tension in the zipper material 24 is controlled by a torque control device that applies an output torque to one of the nip rollers 62 or 64. The torque control device comprises a magnetic particle clutch 66 (also called a "magnetic powder clutch") that is coupled to the lower nip roller 64. However, the torque control device could work equally well if coupled to the upper nip roller 62. Also, another type of torque control device, such as a hydraulic torque converter or the like, could be used in place of a magnetic particle clutch.

The particle clutch 66 has an input shaft and an output shaft, each having a respective pulley attached to its distal end. Similarly, the lower nip roller 64 has an input shaft with a pulley on its end. The particle clutch 66 is operatively coupled to the nip roller 64 by means of a belt or chain 68 that circulates on the respective pulleys attached to the output shaft (dashed circle) of the particle clutch 66 and the input shaft of the nip roller 64. The particle clutch 66 is also operatively coupled to a motor 70 by means of a belt or chain 72 that circulates on the pulley attached to the input shaft of the particle clutch 66 and a pulley on the end of an output shaft of the motor 70.

A particle clutch is an electronic device that applies a torque that is adjusted electronically. A constant-current D.C. power supply (not shown) to the magnetic particle clutch is recommended. This type of power supply will maintain a constant output current so that the output torque will be constant. In the embodiment shown in FIG. 3, the particle clutch is set to output a substantially constant torque that resists rotation of the nip roller 64 in a clockwise direction, as seen in the view of FIG. 3. The magnetic particle is operated in a constant slip mode. While the load torque is less than the output torque, the clutch drives without slip. When the load torque increases to a value exceeding the output torque (and opposite in direction), the clutch will slip smoothly at the torque level set by the input current. The input current to the particle clutch can be electronically set by a system operator via a control panel and associated electronics (not shown). Thus the desired tension level in the zipper material can be set electronically.

During each dwell time, while the zipper shaping, slider insertion and zipper tacking stations are operating, the particle clutch 66 maintains a substantially constant tension in the zone that extends from the nip rollers 62, 64 to the last (most recently tacked) tack zone. The particle clutch maintains a constant bias that resists advancement of the zipper material. When the pulled zipper exerts a load torque greater than the output torque, the particle clutch slips, allowing the zipper material to advance. This occurs during advancement of the packaging film and during zipper accumulation.

FIG. 3 shows part of a thermoforming packaging machine wherein zipper material 24, with sliders 84 (only one of which is shown) inserted thereon, is fed to a zipper tacking station 90 via a deflection roller 26. The components shown in FIG. 3 that bear reference numerals previously seen in FIG. 1 have the functionality previously described. More specifically, a bottom film 16 is unrolled from a supply roll 14 and pulled through a forming station 18, where a respective trough-shaped container or pocket 20 for product is formed by deep-drawing using vacuum and heat during each dwell time. One container is formed for each package-length section of film, but the container is surrounded by a perimeter of film that is not thermoformed, including a lateral margin where the zipper will be attached. The thermoformed bottom film is advanced to a sealing station 34, where a respective package-length section of zipper is joined to each package-length section of film.

However, before each package-length section of thermoformed film reaches the zipper sealing station, the zipper material is tacked (e.g., spot welded by application of heat and pressure or of ultrasound wave energy) to the film by the tacking station 90. The zipper tacks and zipper seals are generally aligned with each other and laterally offset in a cross direction relative to the pockets formed in the film, with the zipper seals connecting the tack zones. Each tack zone is generally aligned with a respective section of non-thermoformed film situated between successive thermoformed pockets 20. The tacking of the tensioned zipper material, in anticipation of zipper sealing, improves the accuracy of zipper placement in relation to the packaging film, thereby providing improved registration of the slider and the end stop structure relative to the pockets formed in the film. Tacking eliminates cross-machine wandering of the zipper going into the zipper sealing station 34. Tacking also facilitates threading of the zipper through the zipper sealing station during startup. Instead of needing to correctly align a section of zipper inside the sealing station before sealing, the system operator need only place the zipper correctly in between the sealing elements at the tacking station and then activate one work cycle of the packaging machine. These steps are repeated until a section of zipper is sealed to the film by the zipper sealing station.

The zipper tacking station 90 comprises a support base 92 attached to the frame of the packaging machine, an arm 98 mounted to the support base 92 (guide roller 26 being rotatably mounted on a distal end of the arm 98), an unheated ("cold") anvil 94 supported by base 92, and a reciprocating heated ("hot") sealing bar 96 having a contact surface that confronts a contact surface of the anvil 94, with a gap therebetween for the zipper 24 and bottom film 16. After each advance of the bottom film, which pulls the zipper through the tacking station, the sealing bar 96 is extended. In the extended position, the sealing bar 96 presses the stationary film and zipper against the anvil 94 and applies sufficient heat to seal the film to the flange of the lower zipper strip (the zipper is on its side) in a tack zone 86. After tacking, the sealing bar 96 is retracted and the joined film-zipper assembly is advanced one package length.

Downstream of the tack zone, a zipper seal is formed along a line segment connecting a pair of successive tack zones 86 at the zipper sealing station 34. More specifically, a respective section of zipper material (with a respective slider mounted thereon) is joined to the bottom film by heat sealing during each dwell time. This may be accomplished by a reciprocating heated sealing bar 35 arranged below the bottom film. The sealing bar 35 reciprocates between retracted and extended positions. In the extended position, the heated (i.e., "hot") sealing bar 35 presses against a stationary unheated (i.e., "cold") bar 37, with the flanges of the zipper material and the non-thermoformed margin of the bottom film sandwiched therebetween. When sufficient heat and pressure are applied, the bottom film 16 is joined to the flange of the lower zipper strip by conductive heat sealing. To prevent seal-through of the zipper flanges, just enough heat is conducted into the zipper material from the hot sealing bar. Alternatively, a separating plate may be interposed between the flanges during sealing, or the zipper flanges may have a laminated construction comprising sealant layers on the exterior.

Downstream of the sealing station 34, a top film (not shown) will be joined to the bottom film along the perimeter of the package. The top film will also be band-sealed to the flange of the upper zipper strip in a manner similar to that described for sealing of the bottom film to the lower zipper strip.

Figure 4:
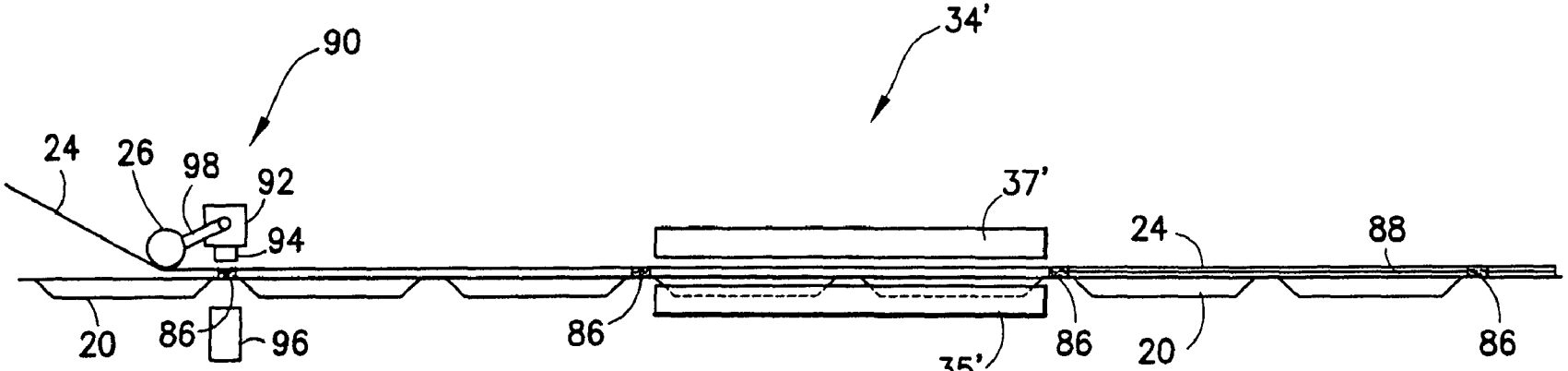
FIG. 4 is a drawing showing a portion of the process pathway inside a packaging machine in accordance with another embodiment of the invention wherein the packaging film is advanced multiple package lengths per advance.
Figure 5:
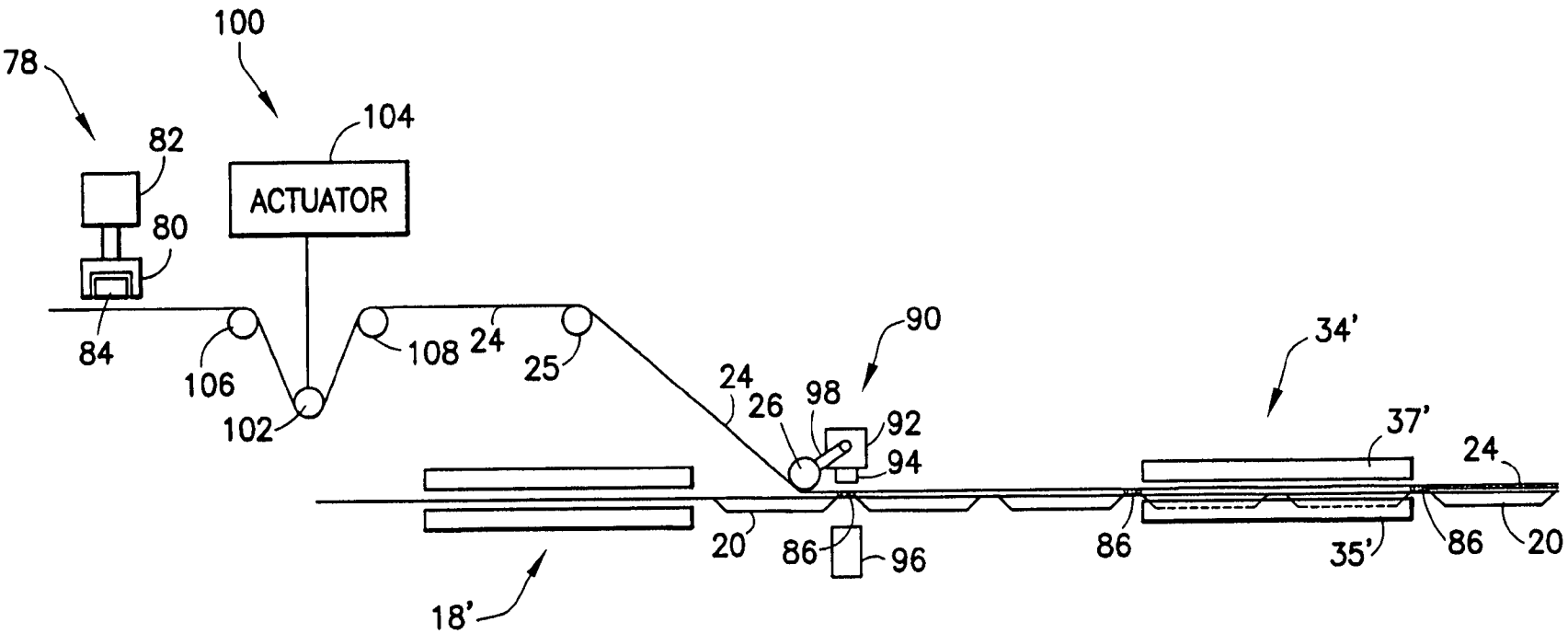
FIG. 5 is a drawing showing portions of the zipper and packaging film process pathways (which overlap inside the packaging machine) in accordance with the embodiment partially depicted in FIG. 4.

A system that advances the film and joined zipper material two package lengths per advance is depicted in FIGS. 4 and 5. The tacking station is unchanged. In this embodiment, the forming device 18' comprises a pair of thermoforming dies for forming two trough-shaped pockets in the web separated by an undisturbed portion of the web. Each set of two concurrently formed pockets is then advanced two package lengths and the zipper tacking and sealing stations are activated in unison. A tack zone is formed once every two package lengths. In the sealing station 34', a respective section (two package lengths long) of zipper material (with two sliders mounted thereon) is joined to the bottom film 16 by heat sealing during each dwell time. This may be accomplished by a reciprocating heated sealing bar 35' arranged below the bottom film. In the extended position, the heated (i.e., "hot") sealing bar 35' presses against a stationary unheated (i.e., "cold") bar 37', with the flanges of the zipper material and an intervening portion of the packaging film sandwiched therebetween. When heat and pressure are applied, the bottom film is joined to the flange of the adjoining zipper strip by conductive heat sealing. Sealing station 34' differs from sealing station 34 in FIG. 3 in that the sealing bars of the former have a length equal to two package lengths, instead of one package length, as is the case in the latter.

Upstream of the two-package advance packaging machine, the slider insertion device 78 inserts one slider at a time. Therefore, the zipper material in the slider insertion zone must be advanced two discrete times, one package length per advance, for each two-package-length advance of the portion of the zipper material disposed in the packaging machine. The differential advancement of the leading and trailing portions of the zipper material is accomplished by placing an accumulator 100 between the slider insertion device 78 and the zipper tacking station 90. The accumulator 100 comprises an actuator 104 and an effector in the form of a roller 102 pivotably mounted on the end of a rod or arm of the actuator. The actuator 104 100 can be of either the linear (e.g., an air cylinder or a linear actuator with ball screw) or rotary variety. FIG. 5 depicts a linear accumulator. A rotary accumulator would comprise a known rotary actuator that converts pneumatically driven linear motion to a rotating motion using a built-in rack and pinion arrangement, a pivotable arm having one end connected to the pinion and the distal end carrying the effector 102.

The accumulator will advance the zipper material through the zipper shaping and slider insertion stations one or more times during the dwell time in the thermoforming packaging machine. However, during slider insertion and the zipper tacking operation, the tension applied by the torque control device (not shown in FIG. 5) is dominant.

Regardless of whether a linear or rotary accumulator is used, the accumulator is designed to retract faster than the packaging machine draws zipper material. The zipper tension during the retraction of the accumulator needs to be below the tension generated by the torque control device and high enough to keep the zipper taut (which is just above zero tension). This is a sufficiently large tension "window"—plus the zipper material is extensible (stretchable)—so that zipper release by retraction need not exactly match the zipper draw by the packaging machine. To achieve the desired tension level, the accumulator effector must exert a force on the zipper that is directed opposite to the direction of retraction. This force can be generated by the weight of the effector, by friction, by damping or by application of a spring force. The retraction of the effector must be completed before completion of the zipper draw by the packaging machine, otherwise a registration error could result.

While the thermoforming packaging machine thermoforms two pockets or containers at once and then advances them two package lengths during one work cycle, the zipper processing equipment will have two work cycles, a respective slider end stop structure being formed and a respective slider being inserted along two contiguous segments of the zipper material during those cycles. In other words, the zipper processing line has two work cycles for every one work cycle of the thermoforming packaging machine. Each work cycle in the zipper processing equipment comprises a dwell time and an advance time. While the bottom film 16 in the thermoforming packaging machine is stationary (during thermoforming), the zipper shaper and slider inserter in the zipper processing line are activated. Thereafter, while the bottom film is still stationary, the accumulator in the zipper processing line is activated, causing the roller 102, which bears against the zipper material, to be moved from a retracted position to an extended position (the extended position is shown in FIG. 5). During this stroke, the roller 102 takes up one package length of zipper material, causing the zipper material upstream of the guide roller 106 to be advanced one package length while the zipper material downstream of the guide roller 108 is stationary. Still during the dwell time of the thermoforming packaging machine, another zipper shaping operation and another slider insertion are concurrently performed. Finally, when the joined bottom film and zipper material (with sliders) is advanced two package lengths in the thermoforming packaging machine, the zipper material downstream of guide roller 108 in FIG. 5 is also advanced two package lengths, while the zipper material upstream of the guide roller 106 is advanced only one package length, due to the fact that the accumulator 100 retracts during bottom film advancement.

The torque control device should provide the desired zipper tension upon completion of each zipper draw by the packaging machine. This ensures proper registration of the zipper and thermoformed packaging film during tacking of the zipper material to the film. During zipper draw by the packaging machine, the zipper tension need not be controlled with equal precision. After zipper draw by the packaging machine and before zipper take-up by the accumulator, the tension in the portion of the zipper immediately upstream from the zipper sealing station may optionally be maintained constant by clamping the zipper material at a point upstream from the zipper sealing station, but downstream from the accumulator. Clamping of the zipper material prior to extension of the accumulator also prevents pullback of the zipper material during take-up, which would lead to registration error. The actuator 104 and the clamp (not shown) may be controlled in synchronism with the packaging machine operations by a programmed logic controller (PLC) or other control means.

The present invention is simple and low in cost, and is also easy to install and tune. Set-up and tuning are straightforward, only requiring macro adjustment of the zipper or film tension. Set-up and tuning of the stroke are not required since the stroke is determined directly by the downstream equipment.

In accordance with an alternative embodiment of the invention, the torque control arrangement with particle clutch and nip rollers is not used and instead, zipper tension in the zone upstream of the zipper sealing station in the packaging machine is controlled by the dancer roll 60 (see FIG. 3). As previously described, dancer roll 60 is supported on a shaft, which shaft is freely vertically displaceable along a slotted support column. The weight of the dancer roller applies a force that takes up slack in the zipper material. During each dwell time, the powered supply reel is stopped and then the zipper shaping, slider insertion and zipper tacking and seal are activated. The magnitude of the zipper tension when the zipper is stationary will be substantially proportional to the weight of the dancer roll. Alternately, spring loading may be used alone or in combination with weight in order to maintain zipper tension. Spring loading has the additional advantage of substantially no inertial forces applied to the zipper. In contrast, weight causes a tension spike above and below the desired zipper tension from the associated weight acceleration and deceleration at the beginning and end, respectively, of the packaging machine draw. Thus, the zipper tension in the zone from the dancer roll to the most upstream tack zone can be maintained at a desired level during each dwell time. For different production runs, the tension in the zipper material can be adjusted by changing the weight of the dancer roll. The system operator must also take into account the amount of sag in the zipper material, which is a function of the length of the aforementioned zone. The use of a dancer roll to control zipper tension is feasible in situations where the tension tolerances are less stringent. If more precise tension control is desired, then the previously described torque control device with tension tip is preferred over the dancer tension control arrangement.

Figure 6:
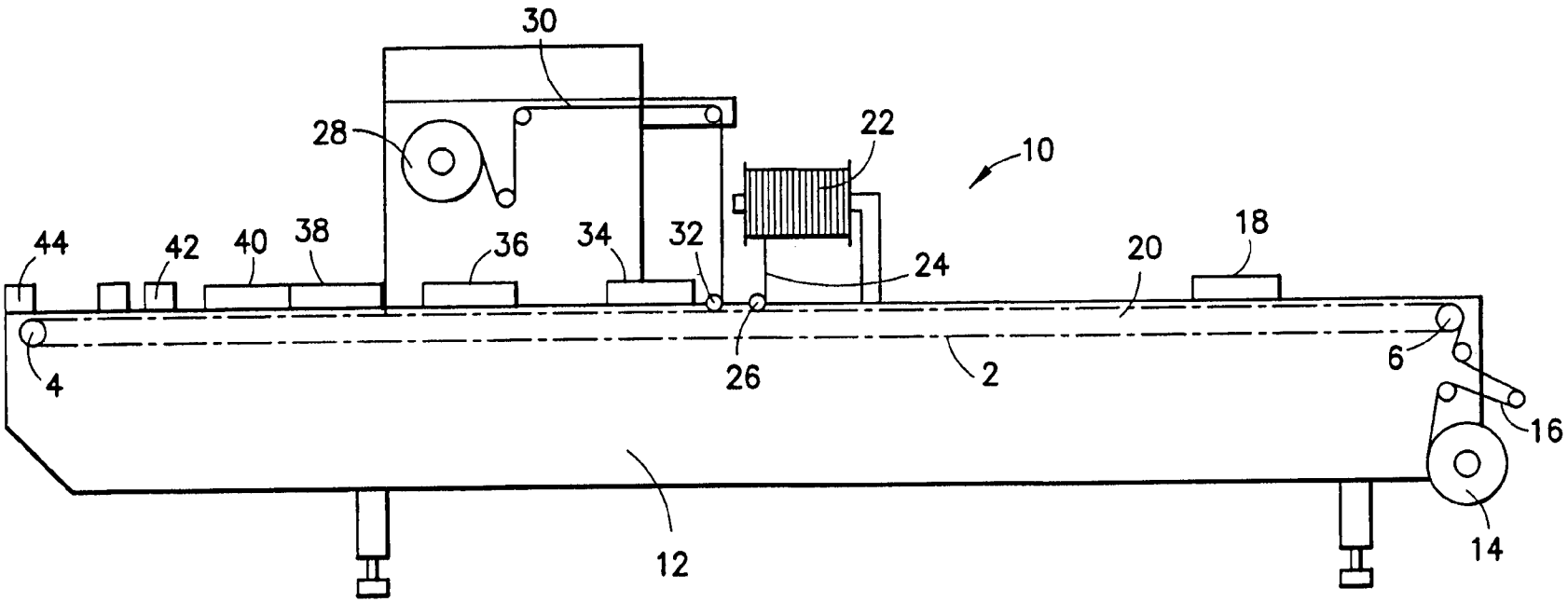
FIG.6 PRIOR ART
FIG. 6 is a drawing showing a side view of the thermoforming packaging machine depicted in FIG. 1.

FIG. 6 shows (in dashed lines) conventional means for advancing a web of packaging film in a thermoforming (i.e., deep-drawing) packaging machine. The components shown in FIG. 6 that bear reference numerals previously seen in FIG. 1 have the functionality previously described. This packaging machine comprises a machine frame 12 having an inlet side where a supply roll 14 with a wound web of packaging film is disposed. The web 16 is drawn off of the roll 14 and fed over a guide roller to a known feeding means, indicated by dashed lines in FIG. 6. The feeding means comprises a pair of endless chain belts 2 (only one of which is depicted in FIG. 6, the other being directly behind) fed over and driven by respective sprocket wheels 4 and 6 and their return points. In a known manner, spring-loaded clamps (not shown) for laterally clamping the edges of the web 16 and for pulling the web through the processing stations of the packaging machine are mounted to the chain belts 2. At the outlet side, the web 16 is released from the clamps. The structural details concerning the various components of the feeding means, such spring-loaded clamps, respective bearing-mounted sprocket wheels and respective engagement discs associated with the sprocket wheels and serving for opening the spring-loaded clamps, are disclosed in full in U.S. Pat. No. 4,826,025 and will not be described in detail herein.

The operations of many system components are coordinated by a programmable logic controller. This control function is generally represented in the block diagram of FIG. 7 for the system with zipper accumulation depicted in FIGS. 4 and 5. The controller 110 may also take the form of a computer or a processor having associated memory that stores a computer program for operating the machine.

The controller 110 is programmed to control the packaging machine in accordance with two phases of an overall system work cycle. In the first phase of the system work cycle, the film advancement mechanism 8 of the packaging machine is activated to advance the web of packaging film multiple package lengths. In the second phase of the system work cycle, the controller 110 de-activates the film advancement mechanism and then activates the pocket forming station 18', the zipper tacking station 90, and the zipper sealing station 34'. During this second phase, multiple pockets are concurrently formed in the web, while an equal number of package lengths of zipper are attached to the web.

In the disclosed embodiments, the controller 110 is also programmed to control most of the components of the zipper processing machine that feeds zipper material to the packaging machine. (The torque setting for tension control of the zipper material is set independently by the system operator.) During the first phase of the overall system work cycle, the power unwind stand 22 is activated to pay out one package length of zipper material and the zipper accumulator 100 is retracted. In one embodiment, the accumulator is retracted first and then more zipper material is paid out from the power unwind stand 22. Alternatively, zipper pay-out and de-accumulation could occur concurrently. Either way, the end result is that, while the packaging film is advanced N package lengths, where N is a positive integer greater than unity (N=2 in the embodiment depicted in FIGS. 4 and 5), the portion of the zipper material upstream of the accumulator is advanced one package length, while the accumulated portions of the zipper material advance more than one package length.

At the start of the second phase of the overall system work cycle, the controller 110 activates the slider insertion device 78 and the ultrasonic horn 74 for zipper shaping and sealing (i.e., stomping). Slider insertion and zipper stomping occur while the zipper material is tensioned and not advancing. After the first slider has been inserted during a particular system work cycle, the controller 110 then activates the zipper accumulator 100 to move to its first extended position, while also activating the zipper unwind stand 22 to pay out another package length of zipper material. Then the slider insertion device and ultrasonic horn are activated again. If N=2, then the controller will initiate the first phase of the system work cycle. If N=3, then the controller will activate the zipper accumulator 100 to move to its second extended position, while also activating the zipper unwind stand 22 to pay out another package length of zipper material. And so forth.

Figure 7:
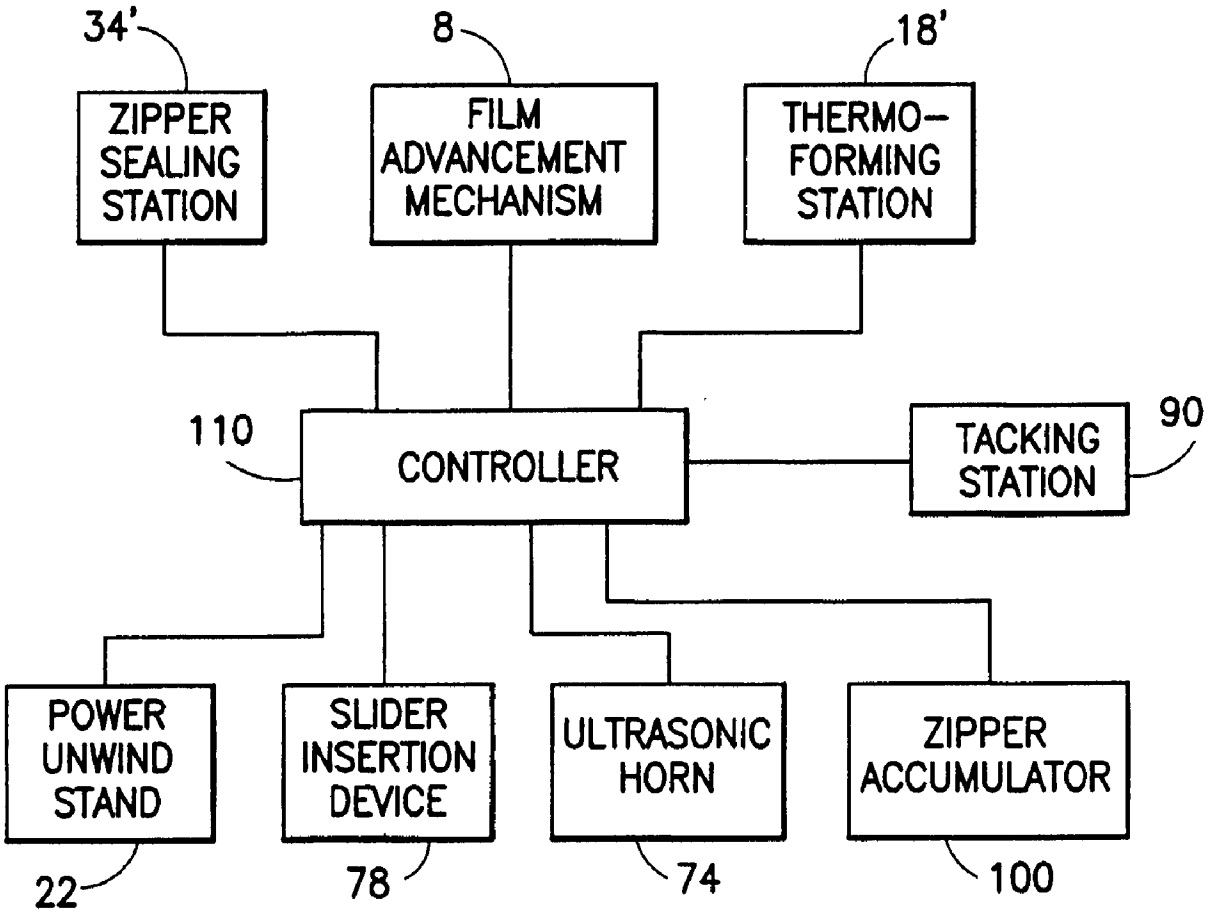
FIG. 7 is a block diagram generally representing programmable control of various components of the disclosed embodiments.

The various components that move between retracted and extended positions (e.g., slider pusher, ultrasonic horn, accumulator effector, clamp, sealing bar, etc.) may be coupled to respective double-acting pneumatic cylinders (not shown in FIG. 7). Alternatively, hydraulic cylinders could be used. Operation of the cylinders is controlled by the programmable controller 110, which selectively activates the supply of fluid to the double-acting cylinders in accordance with an algorithm or logical sequence.

A person skilled in the art of machinery design will readily appreciate that mechanical displacement means other than cylinders can be used. For the sake of illustration, such mechanical displacement devices include rack and pinion arrangements and linear actuators with ball screw.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, tacked, adhered, etc., whether by application of heat and/or pressure, application of ultrasonic energy, application of a layer of adhesive material or bonding agent, interposition of an adhesive or bonding strip, etc.

What is claimed is:

1. A method of manufacture comprising the following steps:

intermittently advancing a first elongated continuous structure made of flexible material along a process pathway during each work cycle, each advance of said first elongated continuous structure being equal in distance to one unit length, said first elongated continuous structure not advancing during a dwell time of each work cycle;

during each dwell time, forming a respective structural feature of a first type on said first elongated continuous structure, said structural features of said first type being spaced at regular intervals, one structural feature of said first type per unit length;

during each dwell time, tacking a respective zone on a second elongated continuous structure made of flexible material to a respective zone on said first elongated continuous structure, said tack zones being spaced at regular intervals along a line that does not intersect said structural features of said first type, one tack zone per unit length, and being generally aligned with respective zones separating said structural features of said first type;

during each dwell time, joining said first and second elongated continuous structures along a respective line segment connecting successive tack zones;

wherein an untacked and unjoined trailing section of said second elongated continuous structure is pulled forward when said first elongated continuous structure is advanced.

2. The method as recited in claim 1, wherein said first elongated continuous structure comprises a web of packaging film, said second elongated continuous structure comprises first and second zipper strips that are interlocked with each other, each of said structural features of said first type is a respective pocket formed in said packaging film, and one unit length equals one package length.

3. The method as recited in claim 2, wherein each of said first and second zipper strips comprises a closure profile and a flange, said tacked zones on said second elongated continuous structure being respective portions of said flange of said first zipper strip.

4. The method as recited in claim 1, further comprising the step, performed during each dwell time, of inserting a respective article on said second elongated continuous structure, said articles being spaced at regular intervals, one article per unit length, said articles being inserted upstream of where said tacking step is performed.

5. The method as recited in claim 4, wherein said first elongated continuous structure comprises a web of packaging film, said second elongated continuous structure comprises first and second zipper strips that are interlocked with each other, each of said structural features of said first type is a respective pocket formed in said packaging film, each of said articles is a respective slider mounted to said first and second zipper strips, and one unit length equals one package length.

6. The method as recited in claim 1, further comprising the step, performed during each dwell time, of forming a respective structural feature of a second type on said second elongated continuous structure, said structural features of said second type being spaced at regular intervals, one structural feature of said second type per unit length, said structural features of said second type being formed upstream of where said tacking step is performed.

7. The method as recited in claim 6, wherein said first elongated continuous structure comprises a web of packaging film, said second elongated continuous structure comprises first and second zipper strips that are interlocked with each other, each of said structural features of said first type is a respective pocket formed in said packaging film, each of said structural features of said second type is formed by fusing said first and second zipper strips, and one unit length equals one package length.

8. The method as recited in claim 1, further comprising the steps, performed during each dwell time, of:

tensioning a portion of said second elongated continuous structure disposed upstream of the most recently tacked tack zone; and inserting a respective article on said tensioned portion of said second elongated continuous structure, said articles being spaced at regular intervals, one article per unit length.

9. The method as recited in claim 1, further comprising the steps, performed during each dwell time, of:

tensioning a portion of said second elongated continuous structure disposed upstream of the most recently tacked tack zone; and forming a respective structural feature of a second type on said tensioned portion in said second elongated continuous structure, said structural features of said second type being spaced at regular intervals, one structural feature of said second type per unit length.

10. A method of manufacture comprising the following steps:

intermittently advancing a first elongated continuous structure made of flexible material along a process pathway during each work cycle, each advance of said first elongated continuous structure being equal in distance to N unit lengths, where N is a positive integer greater than unity; said first elongated continuous structure not advancing during a dwell time of each work cycle;

during each dwell time, forming a respective set of N structural features of a first type on said first elongated continuous structure, said structural features of said first type of each set being spaced at regular intervals in a respective section having a length equal to N unit lengths, one structural feature of said first type per unit length;

during each dwell time, tacking a respective zone on a second elongated continuous structure made of flexible material to a respective zone on said first elongated continuous structure, said tack zones being spaced at regular intervals along a line that does not intersect said structural features of said first type, one tack zone per N unit lengths, and being generally aligned with respective zones separating successive structural features of said first type;

during each dwell time, joining said first and second elongated continuous structures along at least portions of a respective line segment connecting successive tack zones, so that said first and second elongated continuous structures are joined along at least a major portion of each of said line segments connecting successive tack zones;

wherein an untacked and unjoined trailing section of said second elongated continuous structure is pulled forward when said first elongated continuous structure is advanced.

11. The method as recited in claim 10, wherein said first elongated continuous structure comprises a web of packaging film, said second elongated continuous structure comprises first and second zipper strips that are interlocked with each other, each of said structural features of said first type is a respective pocket formed in said packaging film, and one unit length equals one package length.

12. The method as recited in claim 11, wherein each of said first and second zipper strips comprises a closure profile and a flange, said tacked zones on said second elongated continuous structure being respective portions of said flange of said first zipper strip.

13. The method as recited in claim 10, further comprising the step, performed N times during each dwell time, of inserting a respective article on said second elongated continuous structure, said articles being spaced at regular intervals, one article per unit length, said articles being inserted upstream of where said tacking step is performed.

14. The method as recited in claim 13, wherein said first elongated continuous structure comprises a web of packaging film, said second elongated continuous structure comprises first and second zipper strips that are interlocked with each other, each of said structural features of said first type is a respective pocket formed in said packaging film, each of said articles is a respective slider mounted to said first and second zipper strips, and one unit length equals one package length.

15. The method as recited in claim 10, further comprising the step, performed N times during each dwell time, of forming a respective structural feature of a second type on said second elongated continuous structure, said structural features of said second type being spaced at regular intervals, one structural feature of said second type per unit length, said structural features of said second type being formed upstream of where said tacking step is performed.

16. The method as recited in claim 15, wherein said first elongated continuous structure comprises a web of packaging film, said second elongated continuous structure comprises first and second zipper strips that are interlocked with each other, each of said structural features of said first type is a respective pocket formed in said packaging film, each of said structural features of said second type is formed by fusing said first and second zipper strips, and one unit length equals one package length.

* * * * *